US005080263A

United States Patent [19]

Johnson

[11] Patent Number: 5,080,263

[45] **Date of Patent: * Jan. 14, 1992**

[54] OPENER FOR PACKAGES

[75] Inventor: Barbara J. Johnson, Brookfield, Conn.

[73] Assignee: Nestec S.A., Vevey, Switzerland

[ * ] Notice: The portion of the term of this patent subsequent to Jul. 3, 2007 has been disclaimed.

[21] Appl. No.: 162,428

[22] Filed: Mar. 1, 1988

[51] Int. Cl.[5] ..... B43M 7/00

[52] U.S. Cl. ..... 220/277; 383/202; 53/381.1

[58] Field of Search ..... 206/603, 601

[56] References Cited

U.S. PATENT DOCUMENTS

| | | | |
|---|---|---|---|
| 1,816,835 | 8/1931 | Fischer | 206/603 |
| 1,929,599 | 10/1933 | Millholland | 206/603 |
| 1,951,343 | 3/1934 | Butts et al. | 206/603 |
| 2,082,760 | 6/1937 | Berni . | |
| 2,132,741 | 10/1938 | Kyseth | 206/603 |
| 2,459,130 | 1/1949 | Jones | 206/603 |
| 2,992,118 | 7/1961 | Daling | 206/603 |
| 3,220,598 | 11/1965 | Fried et al. . | |
| 3,882,999 | 5/1975 | Wellman | 206/603 |
| 3,900,105 | 8/1975 | Wolfelsperger | 206/603 |
| 4,027,819 | 6/1977 | Herrera-Gutierrez | 206/603 |
| 4,101,042 | 7/1978 | Strong et al. . | |
| 4,150,747 | 4/1979 | Gordon | 206/603 |
| 4,184,597 | 1/1980 | Gavin . | |
| 4,420,080 | 12/1983 | Nakamura . | |
| 4,444,610 | 4/1984 | Tortgrotot et al. | 206/603 |
| 4,712,671 | 12/1987 | Salacuse . | |

*Primary Examiner*—Joseph Man-Fu Moy
*Attorney, Agent, or Firm*—Vogt & O'Donnell

[57] ABSTRACT

A device for opening a flexible package is embodied by a planar tab which has a first tab portion for being secured to a flexible surface of a package to be opened and a second tab portion which contains lines of weakening which define a cutter having a cutting edge for enabling the cutter, by finger pressure, to be broken from the second tab portion at the lines of weakening and to be bent out of a plane defined by the second tab portion for exposing the cutting edge of the cutter for piercing the flexible package surface for opening the package.

10 Claims, 5 Drawing Sheets

FIG.11.
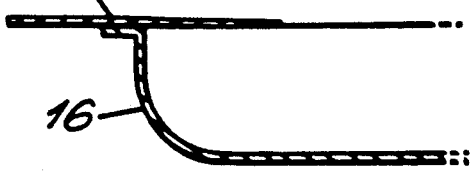
FIG.12.
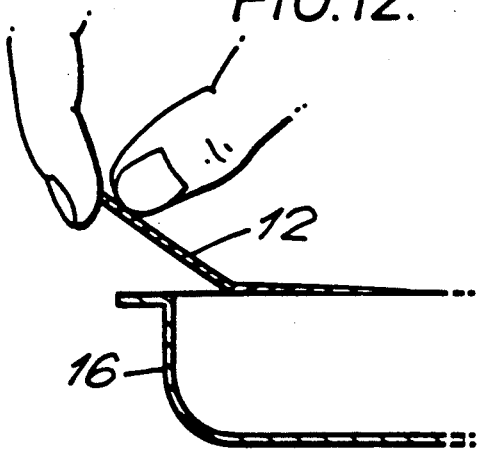
FIG.13.
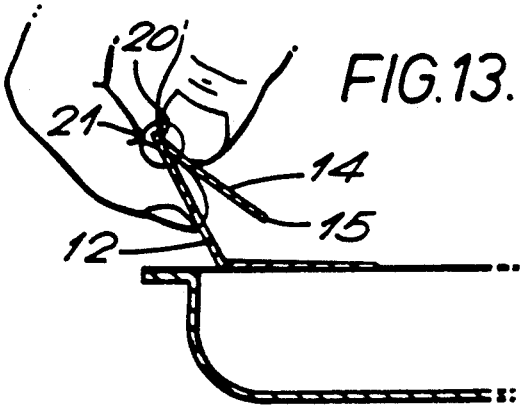
FIG.14.
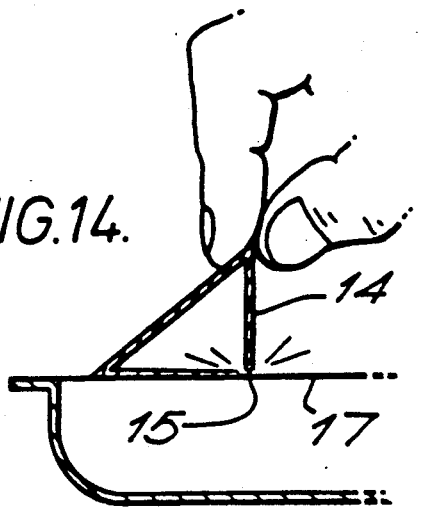
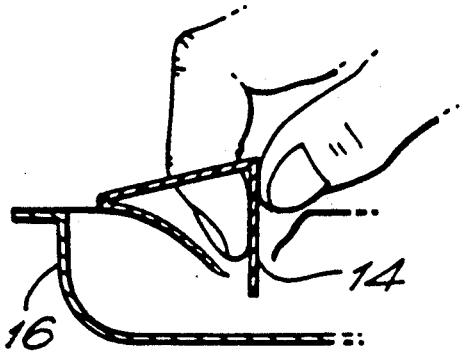
FIG.15.
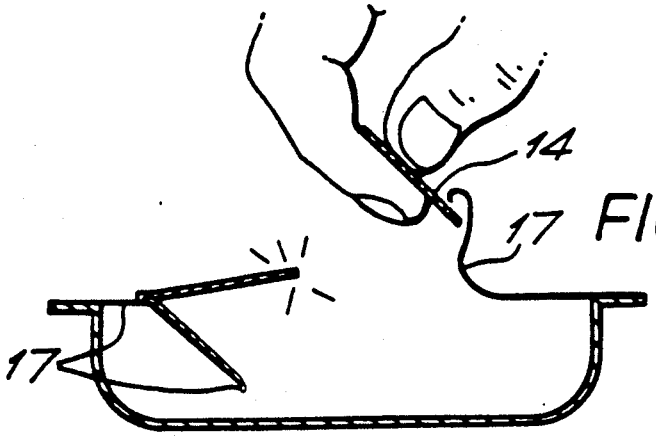
FIG.16.

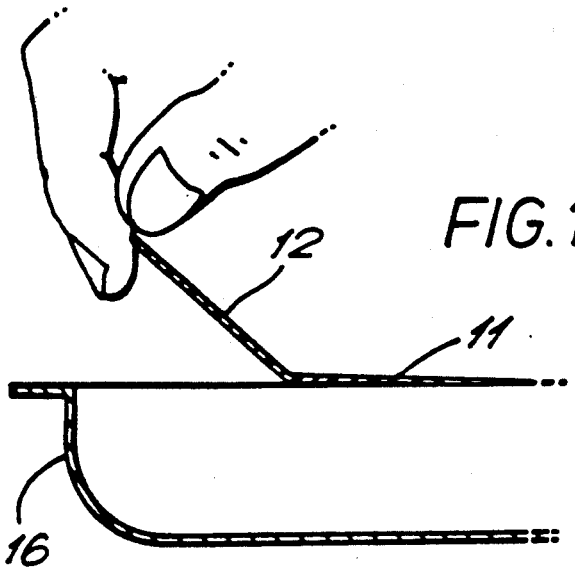
FIG. 17.
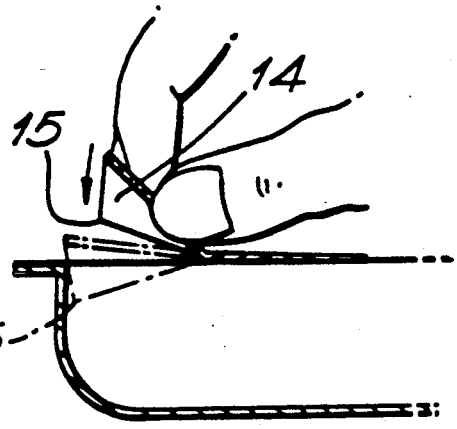
FIG. 19.
FIG. 18.
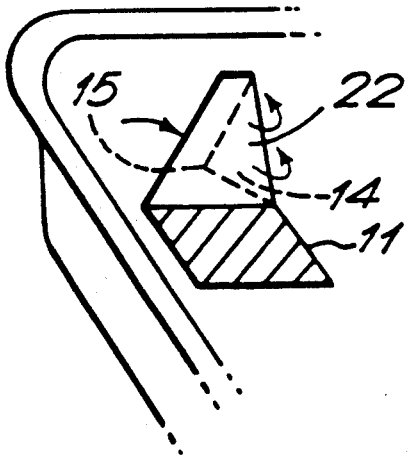
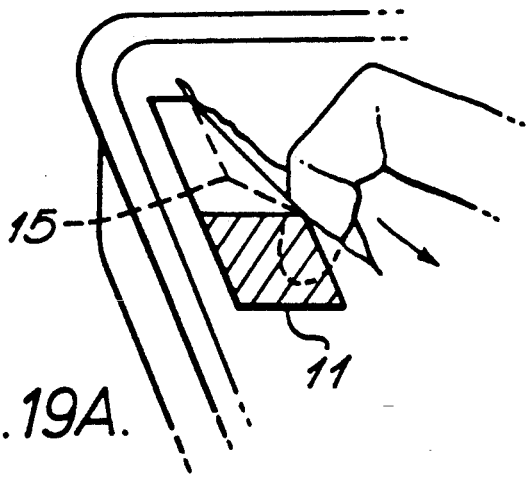
FIG. 19A.

OPENER FOR PACKAGES

CROSS REFERENCE TO RELATED APPLICATION

This application is the parent application of continuation-in-part application Ser. No. 07/219,603, filed July 15, 1988, now U.S. Pat. No. 4,938,362.

BACKGROUND OF THE INVENTION

The present invention relates to a means which aids in the opening of a flexible package.

On most types of "difficult to open" flexible packages, especially for soft products such as pastas, sauces and cheese, printed instructions for opening by cutting with a knife or scissors is commonplace. It would however be more convenient for the consumer if such packages had an easy opening mechanism which did not require the use of tools which may not always be readily available.

SUMMARY OF THE INVENTION

A means has now been developed to aid the opening of a flexible package which means is either secured to the package or is built into the package.

The present invention provides a means which aids in the opening of a flexible package comprising a tab made of a resilient material, lines of weakening in said tab defining a cutter capable of piercing the lidding material of the package, said lines of weakening capable of being bent, broken or turn by finger pressure to expose the cutting edge of the cutter.

In one embodiment of the inventions, as illustrated in more detail below and as shown in drawing FIGS. 1–9, the tab is planar in nature, as defined by its length and breadth, and has a first planar portion for being secured to a flexible surface of a package. A second planar tab portion, which is capable of being bent out of a plane defined by the first tab portion, contains lines of weakening which define the cutter for enabling the cutter, by finger pressure, to be broken from the second tab portion at the lines of weakening and bent out of a plane defined by the length and breadth of the second tab portion for exposing the cutting edge of the cutter for piercing the flexible package for opening the package. A score line may be positioned between the first and second tab portions for assisting in bending the second tab portion out of a plane defined by the length and breadth of the first tab portion.

The invention also provides a flexible package having integral with or secured to it a tab as described above.

DETAILED DESCRIPTION OF THE INVENTION

By "flexible package" in this invention we mean a package in which at least one surface is flexible in nature, e.g., a lid or top membrane, herein referred to as the "lidding material". The package body may be made of plastics material, foil, thin paper or laminates, etc. The tab may be made of a rigid or semi-rigid resilient material such as a thin metal, wood, or heavy gauge plastic and is preferably a slightly flexible material, e.g., PVC, high impact polystyrene and other thermoplastics. The lines of weakening in the tabs may be formed by conventional methods of forming scorelines, for instance, by die cutting or perforating.

The tab may be a separate unit which is secured to the package, for example, by an adhesive. The adhesive should be aggressive enough to hold the tab to the package and withstand abuse in the distribution environment and temperature changes. It may be applied onto the material of the tab either directly or by means of a carrier material such as polyester tape. Alternatively, the tab may be integral with the package, for example, by being part of a flange, or rim, of the package by being positioned around the flange, or rim.

The cutter that is defined by the lines of weakening advantageously has a cutting edge with one or more pointed ends. Preferably, the lines of weakening do not surround the whole of the cutter so that when the lines of weakening are bent, broken, or torn by finger pressure, at least part of the non-cutting edge of the cutter usually remains attached to the tab, but can be broken away with additional force. This enables the consumer to pierce the lidding material of the package with the cutting edge of the cutter while holding the tab, preferably ensuring that the cutting edge pierces substantially at right angles to the lidding material. After piercing the lidding material, the consumer may pull back the lidding material and the tab with the attached cutter to peel open the package. In some cases, the tab body stays intact with the package while the cutter breaks away and is removed with the lidding material.

Advantageously, the tab may be provided with a hole or notch which enables the package to be hung, for example, while on display in the retail centres. Packages without tabs normally are displayed in a near horizontal position which inhibits product display characteristics, whereas when a tab is provided with a hole or notch for the package, the package can be displayed be hanging to enhance display characteristics. The thickness of the tab may be from 0.1 to 1 mm but is more usually from 0.2 to 0.6 mm, preferably from 0.3 to 0.5 mm. The length and breadth of the tab may vary according to the dimensions of the package and, typically, the length may be from 2 to 10 cm, more usually 4 to 4 cm while the breadth may be from 1 to 5 cm, more usually from 2 to 4 cm.

The present invention will now be further illustrated, by way of example only, by reference to the accompanying drawings.

BRIEF DESCRIPTION OF THE DRAWINGS

FIGS. 11–16 illustrate the steps of opening a package by means of the tab represented in FIG. 9.

FIGS. 17–19 illustrate the steps of opening a package by means of the tab represented in FIG. 10.

FIG. 19A illustrates an optional way for opening a package by means of the tab represented in FIG. 10.

DETAILED DESCRIPTION OF THE DRAWINGS

Figure 1:
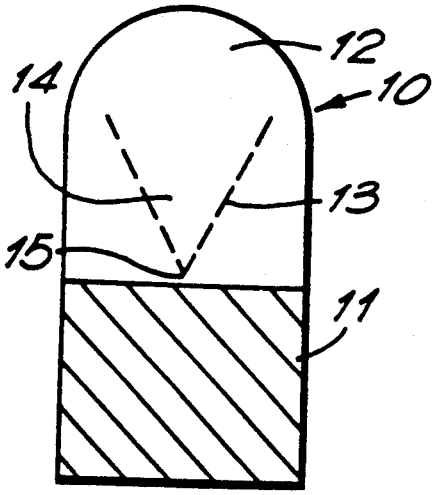
FIG. 1 represents one form of tab according to the present invention.
Figure 2:
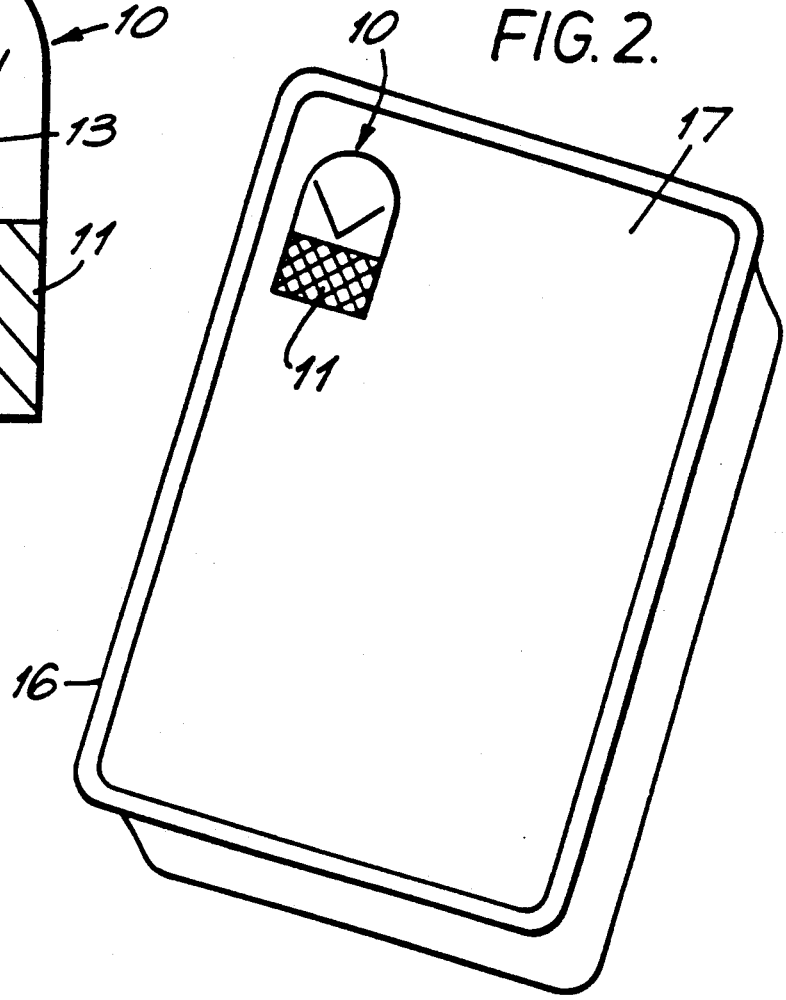
FIG. 2 shows a tab of FIG. 1 adhered to a package.
Figure 3:
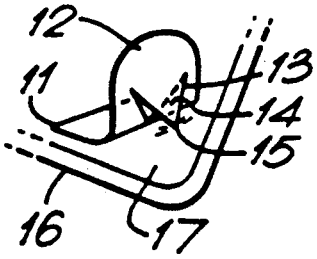
FIGS. 3–5 illustrate the steps of opening the package by means of the tab adhered as in FIG. 2.
Figure 4:
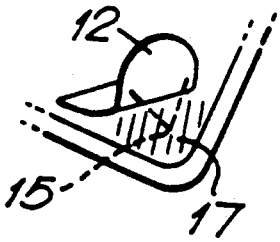
Figure 5:
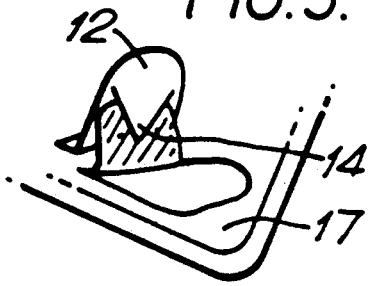

Referring to the drawings, FIG. 1 represents a tab generally designated (10) made of rigid slightly flexible PVC sheet material 0.4 mm thick having a strong adhesive (11) on a first portion of the tab and having a second tab portion (12) which can be gripped and pulled up with the fingers and which contains perforated pre-cut "V" score lines (13) defining cutter (14) with a pointed end (15). FIG. 2 represents a flexible package (16) to which is adhered the tab (10) by means of the first portion of the tab having adhesive (11) on the lidding material (17). To open the package, the second portion (12) of the tab is pulled up by the fingers, then the "V" shaped score lines (13) are broken by the thumb and the cutter (14) is pushed out towards the package as shown in FIG. 3. The cutter is then pierced through the lidding material (17) by its pointed end (15) as shown in FIG. 4 and then the lidding material and the tab are pulled back as one unit with the fingers as shown in FIG. 5 to peel off the lidding material to open the package.

Figure 6:
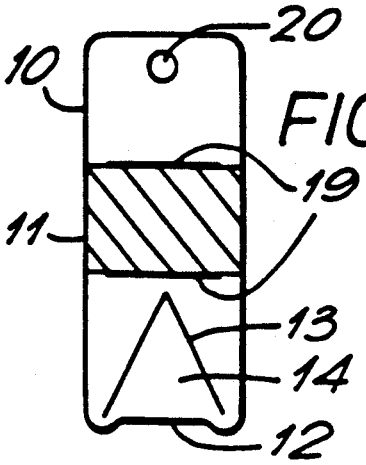
FIGS. 6–10 represent alternative forms of tab which may be adhered to the package.

As shown in FIG. 6, the tab (10) is provided with first portion having adhesive (11), second portion (12), pre-cut "V" score lines (13) defining a cutter (14), a die-cut hole (20) to enable hanging of the package to which the tab is adhered and score lines (19) to allow bending.

Figure 7:
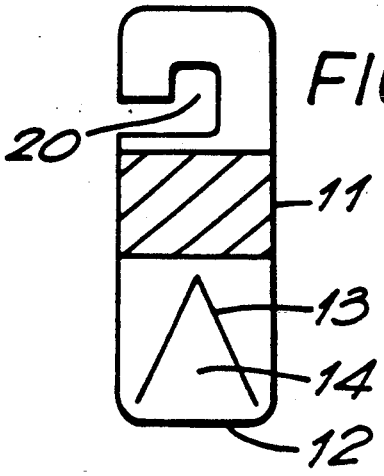
Figure 8:
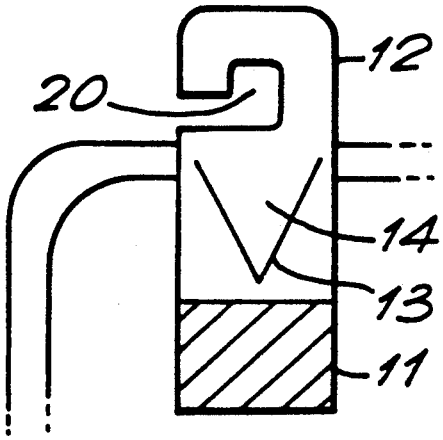

In FIGS. 7 and 8 the tab is provided with first portion having adhesive (11), second portion (12), pre-cut "V" score lines (13) defining a cutter (14) and a notch (20) to enable hanging of the package to which the tab is adhered.

Figure 9:
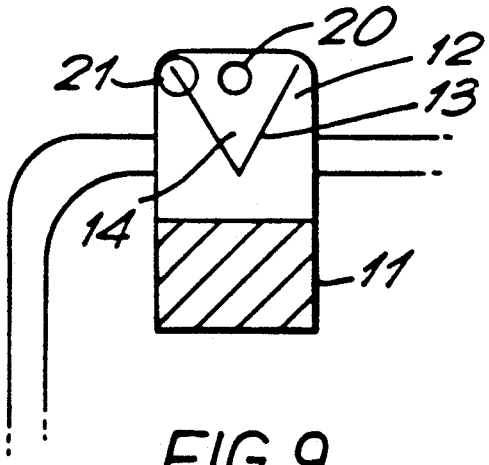

In FIG. 9 the tab is provided with first portion having adhesive (11), second portion (12), pre-cut "V" score lines (13) defining a cutter (14), a die-cut hole (20) to enable hanging of the package to which the tab is adhered, and a pivot point (21).

Figure 10:
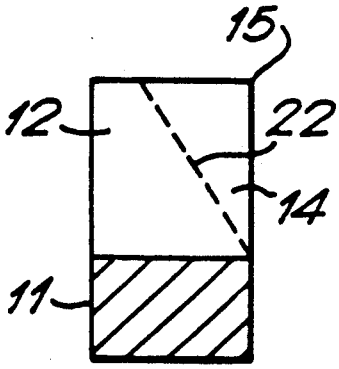
Figure 20:
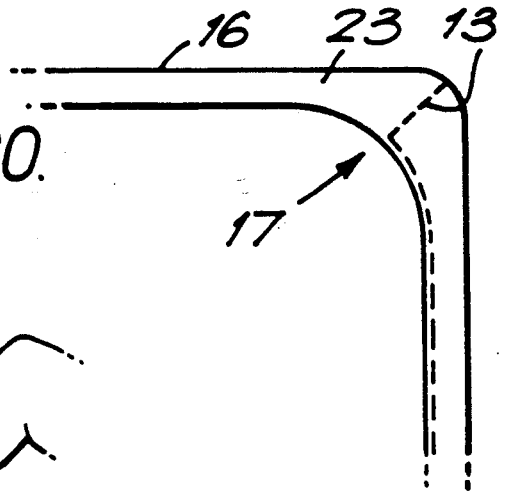
FIGS. 20–23 illustrate a form of tab integral with the package and the steps of opening the package.

In FIG. 10 the tab is provided with first portion having adhesive (11), second portion (12) and a perforated pre-cut score line (22) at which the second portion of the tab can be bent to form a cutter (14) with a pointed end (15).

To open a package with the tab represented in FIG. 9, the second portion (12) of the tab extends beyond the edge of the package (16) as shown in FIG. 11 and is lifted up as shown in FIG. 12. As shown in FIG. 13 the second portion (12) is pulled up and held upright while the cutter is pivoted at the pivot point (21) with the fingers to break the score lines (13) to release the cutter (14) with its pointed end (15). As shown in FIG. 14 the lidding material (17) is pierced by the pointed end (15) of the cutter (14), and as shown in FIG. 15 the cutter penetrates the package, while in FIG. 16, the tab and the lidding material (17) are peeled open with the fingers.

To open a package with the tab represented in FIG. 10, in which the tab is adhered to the lidding material (17) of the package (16) by means of the first tab portion having adhesive (11), the second portion (12) of the tab is pulled up as shown in FIG. 17 and then bent down at the perforated score (22) to form a cutter (14) with a pointed end (15) as shown in FIG. 18. As shown in FIG. 19 the cutter (14) is forced in the direction of the arrows by the fingers to pierce the lidding material with its pointed end and then the tab and lidding material are peeled back to open the package. As another option, the finger is placed into the tear and the lidding material is peeled back to open the package as illustrated in FIG. 19A.

Figure 21:
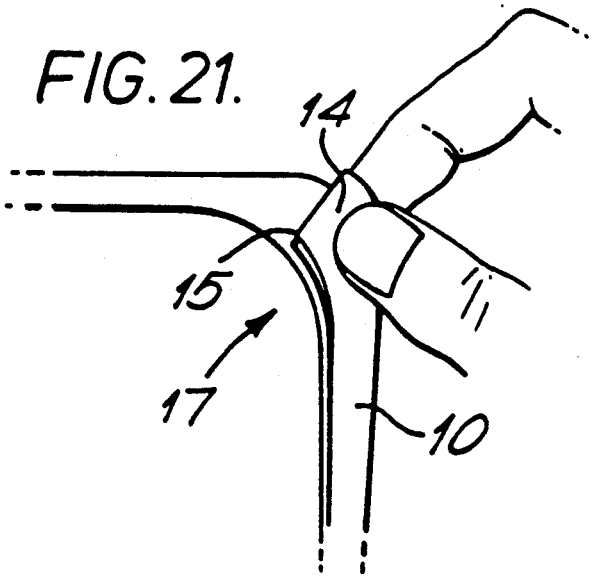
Figure 22:
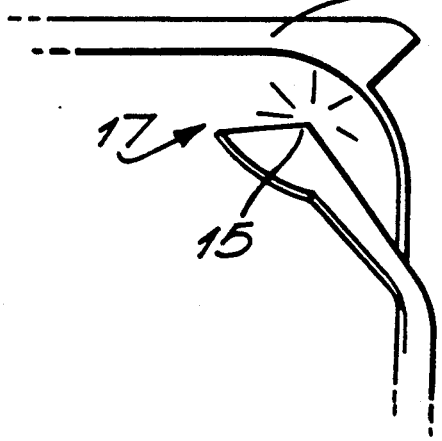
Figure 23:
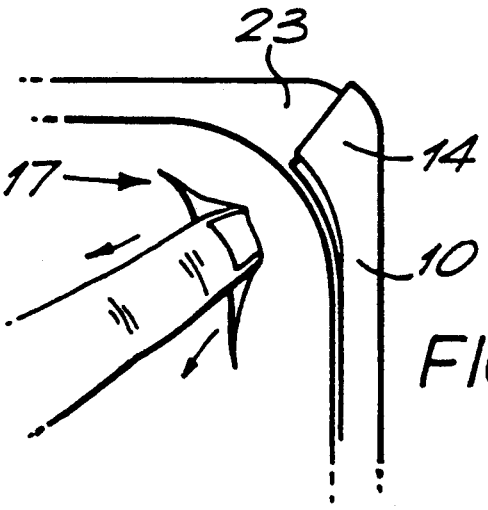

FIGS. 20 to 23 represent one corner of a flexible package (16) with a flange (23) containing perforated pre-cut score lines (13) which can be torn or broken by finger pressure to release the tab (10) and the cutter (14) with a pointed end (15). The tab can be gripped between finger and thumb as shown in FIG. 21 and then folded so that the cutter pierces the lidding material (17) with its pointed edge as shown in FIG. 22. As shown in FIG. 23, after withdrawing the cutter, the finger is placed into the tear and the lidding material is peeled back to open the package.

I claim:

1. A means for aiding opening of a flexible package comprising a planar tab made of resilient material and having a first planar portion for being affixed to a flexible surface of a package and having a second planar portion containing lines of weakening defining a cutter having a cutting edge for enabling the cutter, by finger pressure, to be broken from the second tab portion at the lines of weakening and to be bent out of a plane defined by the length and breadth of the second tab portion for exposing the cutting edge of the cutter for enabling piercing of a flexible surface of a package for opening the package.

2. An opening means according to claim 9 further comprising a score line positioned between the first and second tab portions for assisting in bending the second tab portion out of a plane defined by the length and breadth of the first tab portion.

3. An opening means according to claim 1 wherein the cutting edge of the cutter has at least one pointed end.

4. An opening means according to claim 1 wherein the second tab portion contains two lines of weakening for forming a V-shaped cutter.

5. A package comprising at least one flexible surface and a planar tab made of resilient material and having a first tab portion secured to a flexible surface of the package and having a second planar tab portion containing lines of weakening defining a cutter having a cutting edge for enabling the cutter, by finger pressure, to be broken from the second tab portion at the lines of weakening and to be bent out of a plane defined by the length and breadth of the second tab portion for exposing the cutting edge of the cutter for enabling piercing of the flexible surface for opening the package.

6. A package according to claim 5 wherein the tab further comprises a score line positioned between the first and second tab portions for assisting in bending the second tab portion out of a plane defined by the length and breadth of the first tab portion.

7. A package according to claim 5 wherein the cutting edge of the cutter has at least one pointed end.

8. A package according to claim 5 wherein the second tab portion contains two lines of weakening for forming a V-shaped cutter.

9. A process for enabling opening of a flexible surface of a flexible package comprising:

applying a planar tab made of resilient material, the tab having a first planar portion for being secured to the flexible surface and a second planar portion containing lines of weakening defining a cutter having a cutting edge for enabling the cutter, by finger pressure, to be broken from the second tab portion at the lines of weakening and to be bent out of a plane defined by the length and breadth of the second tab portion for exposing the cutting edge of the cutter for enabling piercing of the flexible surface for opening the package; and securing the first portion to the flexible surface.

10. A process according to claim 9 wherein the tab further comprises a score line positioned between the first and second tab portions for assisting in bending the second tab portion out of a plane defined by the length and breadth of the first tab portion.

* * * * *

UNITED STATES PATENT AND TRADEMARK OFFICE

CERTIFICATE OF CORRECTION

PATENT NO. : 5,080,263

DATED : January 14, 1992

INVENTOR(S) : Barbara J. JOHNSON

It is certified that error appears in the above-identified patent and that said Letters Patent is hereby corrected as shown below:

Column 4, line 18 (line 1 of claim 2), "9" should be --1--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*